United States Patent [19]

Altenburg

[11] 3,997,178

[45] Dec. 14, 1976

[54] CROSS-COUNTRY SKI

[75] Inventor: Georg Altenburg, Andrichsfurt, Austria

[73] Assignee: Fischer Gesellschaft m.b.H., Ried im Innkreis, Austria

[22] Filed: Mar. 21, 1975

[21] Appl. No.: 560,878

[30] Foreign Application Priority Data

Mar. 21, 1974 Austria ..... 2351/74

[52] U.S. Cl. ..... 280/615

[51] Int. Cl.[2] ..... A63C 5/00

[58] Field of Search ..... 280/11.13 L, 11.13 M, 280/11.13 R, 11.13 S, 11.13 F, 11.13 W, 11.13 E

[56] References Cited

UNITED STATES PATENTS

| | | | |
|---|---|---|---|
| 2,038,530 | 4/1936 | Anderson | 280/11.13 L |
| 2,634,136 | 4/1953 | Tribelhorn | 280/11.13 L |
| 2,971,207 | 2/1961 | Eicholtz | 280/11.13 L |
| 2,995,379 | 8/1961 | Head | 280/11.13 L |
| 3,258,795 | 7/1966 | Mailhot | 280/11.13 L |
| 3,369,821 | 2/1968 | Weber | 280/11.13 L |
| 3,612,556 | 10/1971 | Seawell | 280/11.13 L |
| 3,738,675 | 6/1973 | Hashimoto | 280/11.13 L |
| 3,816,573 | 6/1974 | Hashimoto et al. | 280/11.13 L |

*Primary Examiner*—M. H. Wood, Jr.
*Assistant Examiner*—David M. Mitchell
*Attorney, Agent, or Firm*—Imirie, Smiley & Linn

[57] ABSTRACT

A cross-country ski which consists of a composite or sandwich structure comprising a core which comprises at least two layers, which define an interface that is approximately parallel to the tread face, the uppermost layer of the core consisting of wood, the lowermost layer of the core extending substantially from the rear end of the ski at least to the rear end of the scoop consisting at least in part of foamed plastics material, and the upper layer having preferably a thickness of at least 1.5 mm at its thickest part and having a length which in dependence on the profile of the core and the thickness of the layer is shorter than the ski and consists of wood which in the direction of its grain has a modulus of elasticity of at least $3 \times 10^5$ $Ncm^{-2}$.

5 Claims, 3 Drawing Figures

FIG. 1

CROSS-COUNTRY SKI

SUMMARY OF THE DISCLOSURE

Figure 1:
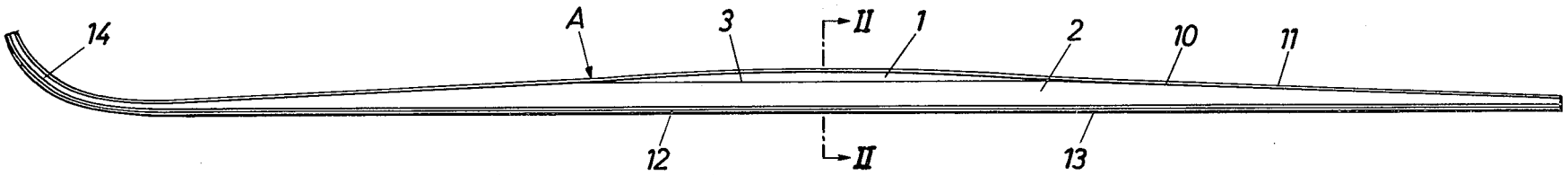

A cross-country ski which consists of a composite or sandwich structure having a core which comprises at least two superimposed layers, which extend in the longitudinal direction of the ski. The upper layer of the core consists of wood and is shorter than the ski. The lower layer of the core is made of foamed plastics material and extends from the rear end of the ski at least to the rear end of the scoop.

This invention relates to a cross-country ski which consists of a composite or sandwich structure.

It is known to make the body of a wooden ski from a plurality of layers, which are parallel to the tread face. The top face of the ski and its tread face are formed by plywood layers which have veneers that extend at right angles to the tread surface. Such skis lack the properties desired for cross-country skiing or do not sufficiently possess them.

Cross-country skis must have a central portion which has a resistance to bending which is 50 to 100 times the resistance to bending of the scoop portion and the rear end portion of the ski. When wood is used as a structural material, this requirement is met by the use of a suitable profile. The use of a composite or sandwich structure comprising a core of foamed plastics material and stressed facings involves various disadvantages compared to the use of wood. For instance, poplar wood having an average density of 0.4 g/cm$^2$ has a modulus of elasticity of 7–8 $\times$ 10$^5$ Ncm$^{-2}$ whereas foamed plastics materials having a comparable density have a modulus of elasticity not in excess of 5–8 $\times$ 10$^4$ Ncm$^{-2}$. For this reason, for given dimensions, the contribution of the core of foamed plastics material to the stiffness of the composite structure is much smaller than that of a wooden core. To compensate this, the facings or the core must be thicker.

Another disadvantage of cores of foamed plastics material resides in that the resistance of the binding-holding screws to being torn out is inadequate in such cores. It is known to embed reinforced plates of metal or other material of higher strength in ski cores of foamed plastics material.

It is an object of the invention to avoid the disadvantages stated above. This is accomplished according to the invention by the use of a core which comprises at least two layers defining an interface which is approximately parallel to the tread face, the uppermost layer of the core consisting of wood. According to a feature of the invention the lowermost layer extends substantially from the rear end of the ski at least as far as to the rear end of the scoop and consists at least in part of foamed plastics material. The upper layer has preferably a thickness of at least 1.5 mm at the thickest part of the ski and in dependence on the profile of the core and the thickness of the layer is shorter than the ski and consists of wood which in the direction of its grain has a modulus of elasticity of at least 3 $\times$ 10$^5$ Ncm$^{-2}$.

Further details of the cross-country ski according to the invention will be explained more fully with reference to the drawing, which shows diagrammatically embodiments of two cross-country skis which have different cores.

FIG. 1 is a side elevation showing the ski with its core and

Figure 2B:
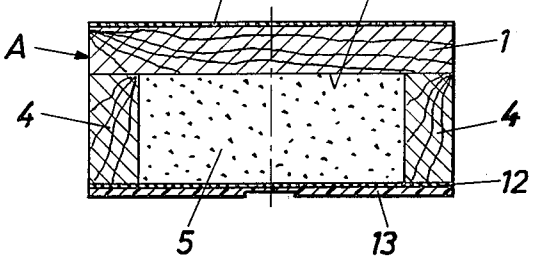
Figure 2A:
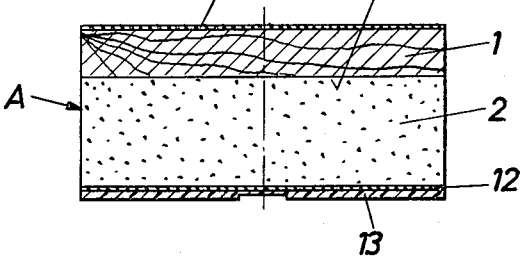

FIGS. 2*a* and 2*b* are sectional views taken on line II—II in FIG. 1 and showing skis having different cores.

The ski A comprises a core 10, an upper facing 11 of glass fiber-reinforced plastics material, a lower facing 12 also of glass fiber-reinforced plastics material, and a tread covering 13.

The core 10 consists of a plurality of superimposed layers. Each interface between adjacent layers is approximately parallel to the tread face. In the present case the core consists of two layers 1, 2. The upper layer 1 is provided in the thickest portion of the core next to the top face of the ski and consists of wood having a modulus of elasticity of at least 3 $\times$ 10$^5$ Ncm$^{-2}$. This layer has preferably a thickness of at least 1.5 mm at its thickest point. Its length depends on the profile of the core and is smaller than the length of the ski. The lower layer 2 extends substantially from the rear end of the ski at least to the rear end of the scoop 14 and preferably into the same, as shown, and consists at least in part of foamed plastics material.

FIGS. 2*a* and 2*b* show two embodiments, to which the invention is not restricted in scope. The layer 2 shown in FIG. 2*a* consists of foamed plastics material throughout its width. FIG. 2*b* shows wooden strips 4, which are provided at the side faces and extend at right angles to the interface 3. The space 5 between the wooden strips is filled with foamed plastics material. This desirable arrangement protects the foamed plastics material against wear. The wooden strips may alternatively be arranged in a different manner.

The core designed in accordance with the invention affords particularly the following advantages:

1. A material having a high modulus of elasticity is provided in the middle portion of the core. This middle portion lies in the compression zone when the core is under bending load and must have a much higher resistance to bending than the scoop and rear end portions. As a result, a ski having the required resistance to bending can be provided with smaller stressed facings and with a smaller overall height.

2. Special reinforcing plates need not be embedded in the core to receive the screws for fixing binding.

3. The layer 2 shown in FIG. 2*b* provides an effective protection of the side faces against wear.

What is claimed is:

1. A cross-country ski having a scoop formed at a front end thereof, comprising a composite sandwich body which comprises a core, a layer which covers the upper surface of said core, a layer which covers the underside of said core, and a tread covering which covers the layer that covers the underside of said core, said core comprising a plurality of directly superimposed core layers, which extend in the longitudinal direction of the ski and define between them at least one interface which extends substantially parallel to said tread covering, said core layers comprising an uppermost core layer of wood and a lowermost core layer which consists at least in part of foamed material, said uppermost core layer being shorter than the ski and having a thickness which is largest in an intermediate portion and decreases toward the ends.

2. A ski as set forth in claim 1, characterized in that the core consists of two superimposed core layers and the uppermost of said core layers has a thickness of at least 1.5 mm at said intermediate portion and consists of wood having in the direction of its grain a modulus of elasticity of at least 3 $\times$ 10$^5$ Ncm$^{-2}$.

3. A ski as set forth in claim 1, characterized in that the lowermost core layer extends substantially from the rear end of the ski at least to the rear end of the scoop.

4. A ski as set forth in claim 1, characterized in that the lowermost core layer comprises a combination of foamed plastics material and of wooden strips arranged lengthwise and having a larger cross-sectional dimension in the vertical direction than in the horizontal direction.

5. A ski as set forth in claim 4, characterized in that said wooden strips are disposed on each side of the layer of foamed plastics material.

* * * * *